US006145575A

United States Patent [19]

Leingruber

[11] Patent Number: 6,145,575

[45] Date of Patent: Nov. 14, 2000

[54] CONTINUOUS CASTING MACHINE

[75] Inventor: Franz Leingruber, Linz, Austria

[73] Assignee: Voest-Alpine Industrienlagenbau GmbH, Austria

[21] Appl. No.: 09/194,061

[22] PCT Filed: May 9, 1997

[86] PCT No.: PCT/AT97/00092

§ 371 Date: Dec. 14, 1998

§ 102(e) Date: Dec. 14, 1998

[87] PCT Pub. No.: WO97/44150

PCT Pub. Date: Nov. 27, 1997

[30] Foreign Application Priority Data

May 20, 1996 [AT] Austria ..... 886/96

[51] Int. Cl.[7] ..... B22D 11/53; B22D 11/114; B22D 11/128

[52] U.S. Cl. ..... 164/151.3; 164/416; 164/442

[58] Field of Search ..... 164/416, 442, 164/448, 151.3

[56] References Cited

U.S. PATENT DOCUMENTS

| | | | |
|---|---|---|---|
| 3,700,073 | 10/1972 | Bode, Jr. | 164/448 |
| 3,779,303 | 12/1973 | Pietryka . | |
| 4,129,173 | 12/1978 | Scheurecker et al. . | |
| 4,544,015 | 10/1985 | Scheurecker et al. | 164/442 |
| 5,072,774 | 12/1991 | Schilcher | 164/151.3 |

FOREIGN PATENT DOCUMENTS

| | | | |
|---|---|---|---|
| 347057 | 4/1978 | Austria . | |
| 384970 | 2/1988 | Austria . | |
| 0064490 | 11/1982 | European Pat. Off. | 164/442 |
| 0557538 | 9/1993 | European Pat. Off. . | |
| 1508963 | 11/1969 | Germany . | |
| 1957689 | 11/1969 | Germany . | |
| 2200129 | 7/1972 | Germany . | |
| 3000117 | 7/1981 | Germany | 164/416 |

*Primary Examiner*—J. Reed Batten, Jr.
*Attorney, Agent, or Firm*—Ostrolenk, Faber, Gerb & Soffen, LLP

[57] ABSTRACT

The machine includes a mold to be inserted in a frame-type mold table, a strand guide connected downstream of the mold and a mold oscillator supporting and moving the mold table. In order to minimize restranding times during section change through the formation of a section-related machine head, a first strand guide segment is detachably integrated in a strand guide segment connected downstream and a mold stirrer is supported on the second strand guide segment.

7 Claims, 2 Drawing Sheets

CONTINUOUS CASTING MACHINE

BACKGROUND OF THE INVENTION

The invention relates to a continuous casting machine, particularly to a billet or bloom caster, with a mold to be inserted in a frame-type mold table and a strand guide connected downstream of the mold and comprised of several strand guide segments carrying strand guide rollers and with a mold oscillator supporting and moving the mold table.

Continuous casting machines generally serve to cast strands of different cross-sectional dimensions within a minimum restranding time and requiring a minimum number of spare parts. Large-section strands are cast with adjustable plate molds, whereas for strands with billet cross sections and partly for strands with bloom cross sections tubular molds are used which are exchanged upon section change. Exchanging the mold alone is not sufficient since there is still a liquid zone inside the strand and the hot strand shell, still being thin and easily deformable, must be supported without misalignment particularly after exiting the mold, so the strand guide segment connected downstream must also be exchanged.

A continuous casting machine of this type is already known from DE-A 19 57 689, where the mold, the mold table carrying the mold, the mold oscillator and a first strand guide segment are located within a detachable three-dimensional frame. This frame can be lifted and exchanged together with all its enclosures. At the same time the next strand guide segment located beneath is also accessible and exchangeable. According to the specifically described embodiment, the mold with the mold table and the first strand guide segment are separately located in the three-dimensional frame. This arrangement does not provide for automatic adjustment of the components to one another. Especially the alignment of the plane formed by the shaping inside wall of the mold and the generatrix (strand surface) to be put against the rollers of the first strand guide segment is highly important due to thin strand shell and requires exact and laborious adjustment.

A continuous casting machine is known from AT-PS 347 057, where a mold and the foot roller stand attached to the mold on the exit side and a bending zone connected downstream of the foot roller stand can be jointly dismantled from the continuous casting machine through a supporting frame comprising the mold and the bending zone.

This conception requires repeated adjustment of the individual components to one another. One the one hand, the wall of the mold cavity must be adjusted to the generatrix of the downstream foot rollers and these foot rollers must be adjusted to the strand guide rollers of the subsequent bending zone using an appropriate measuring ruler. On the other hand, how to adjust other components located in the mold area, such as the mold stirrer or the mold level measuring system, remains unclear.

SUMMARY OF THE INVENTION

Accordingly, the technical problem of the invention is to avoid the aforementioned disadvantages and to form an assembly comprised of the known components normally used in a continuous casting machine, i.e. mold, mold table, mold oscillator, downstream strand guide, possibly additional equipment such as mold stirrer and mold level measuring system, which allows short restranding times through the formation of a section-related machine unit and reduced maintenance expenditure through the modular design of the machine components.

This problem is solved by detachably integrating a first strand guide segment preferably designed as foot roller stand in a second strand guide segment connected downstream and preferably designed as bending zone and by supporting a mold stirrer on the second strand guide segment. This arrangement has the special advantage that only the first and second strand guide segments forming an assembly are to be adjusted in the workshop.

A particularly expedient embodiment results from designing the second strand guide segment in the area of the mold with raised supports which are provided with bearing surfaces for the mold or the mold table carrying the mold and with fasteners, preferably hooks or lugs, for the common dismantling of the mold, mold stirrer and second strand guide segment.

An improvement of the invention results from installing a mold level measuring system, consisting of a radioactive source, preferably a cobalt source, and a scintillation counter on the mold stirrer or on the supports of the second strand guide segment. This arrangement allows to place the mold level measuring system, which does not oscillate in resonance, very close to the mold cavity and thus to minimize the capacity of the cobalt source while at the same time maintaining a stable and clearly defined position for the mold level measuring system.

An especially stable continuous casting machine operating without misalignment can be achieved by designing the mold oscillator as four-eccentric oscillator with spring band steel guide.

BRIEF DESCRIPTION OF THE DRAWINGS

One embodiment of the invention is explained in greater detail by means of two figures, with FIG. 1 displaying a schematic longitudinal section through the continuous casting machine in the area of the mold and of the strand guide connected downstream and FIG. 2 illustrating a different section of the same embodiment.

DESCRIPTION OF THE PREFERRED EMBODIMENT

Figure 1:
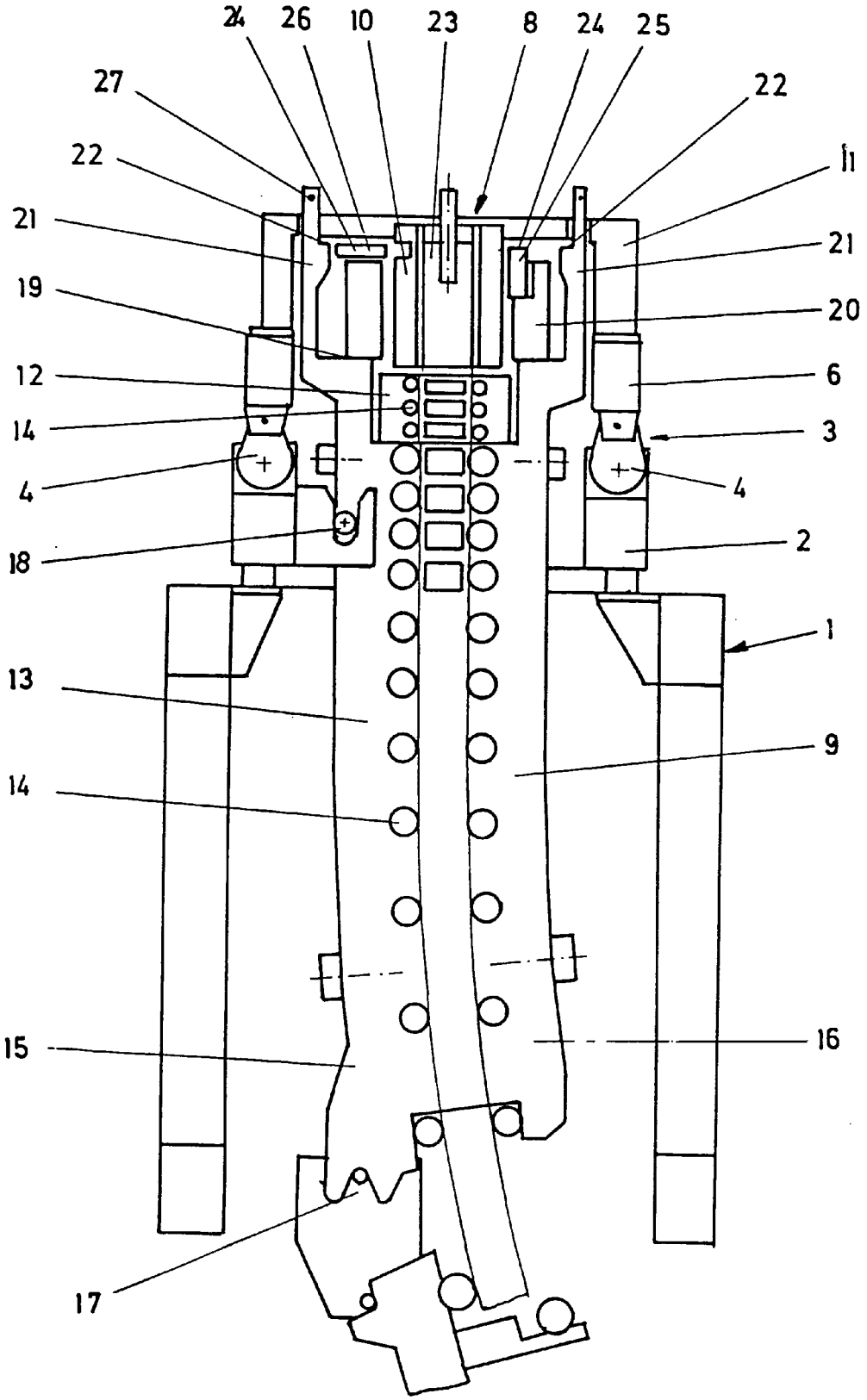
Figure 2:
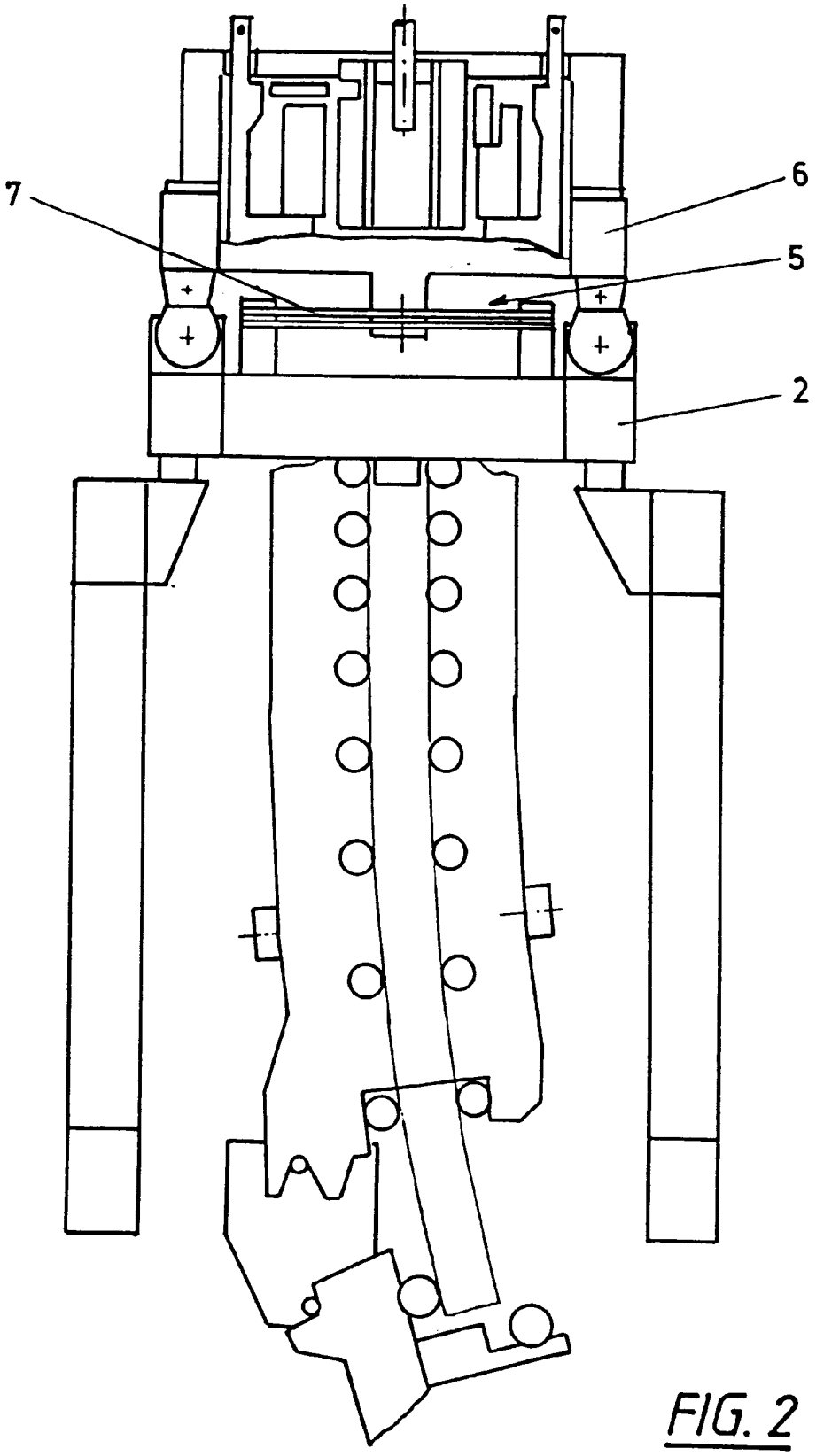

The continuous casting machine is supported on stationary machine supporting structure 1. Mold oscillator 3 which is comprised of four-eccentric oscillator 4 and spring band steel guide 5 is fixed on supporting frame 2 of machine supporting structure 1. Mold oscillator 3 is represented and described in detail in AT-PS 384 970. It is mainly comprised of four eccentrics which are located in the corner areas of supporting frame 2 and driven by a common rotating drive, with the rotating motion produced thereby being transformed into a vertical oscillating motion through short connecting rods. The connecting rods of mold oscillator 3 are connected to frame-type mold table 6, which absorbs the oscillating motion and transfers it to mold 8. As can be seen from FIG. 2, spring band steel guide 5 is located between mold table 6 and supporting frame 2 and mainly comprised of several spring band steel guides 7 or comparable flexible elements whose ends are fixedly clamped to supporting frame 2 and whose central area is connected to mold table 6. This arrangement ensures exact positioning of the oscillating machine parts in relation to the stationary machine parts, particularly the alignment of oscillating mold 8 in relation to strand guide 9 which is supported on machine supporting structure 1.

Mold 8 is comprised of mold element 10 and portal-type mold frame 11 in which mold element 10 is inserted. Mold element 10 has a shaped cavity which corresponds to the section of the strand to be cast and consists of a copper tube or copper plates as well as a backing structure with appropriate equipment for mold cooling.

In the direction of strand withdrawal, strand guide 9, which withdraws and supports the hot strand, includes first strand guide segment 12 and second strand guide segment 13 which are connected downstream of mold 8.

First strand guide segment 12 is designed as framework in which several rows of strand guide rollers 14 forming a closed cage are pivoted and forms an assembly that is detachably fixed in second strand guide segment 13. Second strand guide segment 13 is designed as bipartite frame, with outer bow frame 15 and inner bow frame 16 being provided with strand guide rollers 14 and inner bow frame 16 being clamped to outer bow frame 15. Second strand guide segment 13 is supported on machine supporting structure 1 through outer bow frame 15 with bearing 17 and sliding bearing 18. Outer bow frame 15 with its strand guide rollers 14 moreover represents the reference side for adjusting the continuous casting machine.

Second strand guide segment 13 shows bearing surface 19 on which mold stirrer 20 is supported and is positioned at a distance from mold element 10. In the area of the mold, second strand guide segment 13 is provided with raised supports 21 with bearing surfaces 22, which engage with mold 8 and mold frame 11, respectively, when second strand guide segment 13 is dismantled, and which allows easy dismantling and installation of the common component comprised of mold 8, mold stirrer 20, first strand guide segment 12 and second strand guide segment 13, which is referred to as section-related machine unit, within a short restranding time. According to an embodiment not represented, bearing surfaces 22 can also be brought into engagement with mold table 6 during installation or dismantling of the machine unit. Furthermore, raised supports 21 are provided with fasteners 27, which are designed as hooks or lugs and to which a hoisting gear is hinged for installation and dismantling purposes.

In order to be able to continuously check the level of the molten metal bath in mold 8, mold level measuring system 24, which does not oscillate in resonance and which is comprised of radioactive source 25 and scintillation counter 26, is installed on mold stirrer 20 in the area of mold level 23. According to an embodiment not represented, radioactive source 25 and scintillation counter 26 can be mounted to raised supports 21.

In this arrangement of components of the continuous casting machine, the shaped cavity of mold 8 can be easily centered to strand guide rollers 14 of strand guide segments 12, 13 connected downstream by means of a measuring contact blade. The section-related machine head preset in this way can be placed on mold table 6 and fixed without any further adjusting work.

Coolant for the mold is circulated through supply and discharge lines not represented which lead through mold frame 11 and mold table 6 and which are automatically closed when mold 8 is placed on mold table 6.

What is claimed is:

1. A continuous casting machine, comprising:

a mold table, a mold inserted on and supported on the mold table, a mold oscillator supporting the table and moving the table upon the mold oscillator oscillating;

the mold having a downstream side where a strand exits the mold;

a strand guide connected downstream of the mold; the strand guide being comprised of a plurality of strand guide segments, and each strand guide segment including strand guide rolls for guiding the strand downstream through the respective guide segment; a first strand guide segment downstream of the mold comprising a foot roller stand; a second strand guide segment downstream of the first strand guide segment, and the first strand guide segment being detachably integrated in the second strand guide segment; and a mold stirrer supported on the second strand guide segment for stirring the mold.

2. The continuous casting machine of claim 1, wherein the second guide segment is shaped to define a bending zone for bending the strand passing therethrough.

3. The continuous casting machine of claim 1, further comprising a mold level measuring device comprising a radioactive source and a scintillation counter are installed on the mold stirrer.

4. The continuous casting machine of claim 1, further comprising raised supports on the second guide segment extending up to the area of the mold, the supports being provided with bearing surfaces for positioning the mold and the mold table.

5. The continuous casting machine of claim 4, further comprising fasteners for common installation and dismantling of the mold, the mold stirrer and the second strand guide segment.

6. The continuous casting machine of claim 4, further comprising a mold level measuring device comprising a radioactive source and a scintillation counter supported at the mold, wherein the radioactive source and the counter are installed at the supports of the second strand guide segment.

7. The continuous casting machine of claim 6, wherein the mold oscillator comprises four eccentric oscillators, each with a respective guide connected to the mold table.

* * * * *